US010722028B2

(12) United States Patent
Lee

(10) Patent No.: US 10,722,028 B2
(45) **Date of Patent: *Jul. 28, 2020**

(54) TABLE CONNECTION MECHANISM AND METHOD OF USING THE SAME

(71) Applicant: Knoll, Inc., East Greenville, PA (US)

(72) Inventor: Jeffrey P. Lee, Mertztown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/532,629

(22) Filed: Aug. 6, 2019

(65) Prior Publication Data

US 2019/0357677 A1 Nov. 28, 2019

Related U.S. Application Data

(63) Continuation of application No. 16/101,872, filed on Aug. 13, 2018, now Pat. No. 10,413,063.

(60) Provisional application No. 62/545,195, filed on Aug. 14, 2017.

(51) Int. Cl.

| | |
|---|---|
| ***A47B 87/00*** | (2006.01) |
| ***A47B 13/02*** | (2006.01) |
| *A47B 9/10* | (2006.01) |
| *A47B 9/20* | (2006.01) |
| *A47B 83/00* | (2006.01) |

(52) U.S. Cl.

CPC ..... *A47B 87/002* (2013.01); *A47B 13/02* (2013.01); *A47B 9/10* (2013.01); *A47B 9/20* (2013.01); *A47B 83/001* (2013.01); *A47B 2087/004* (2013.01); *A47B 2200/0012* (2013.01); *A47B 2200/0046* (2013.01)

(58) Field of Classification Search

CPC ..... A47B 87/002; A47B 9/20; A47B 9/10

USPC ..... 108/64, 153.1, 180, 187, 186, 158.13, 108/147

See application file for complete search history.

(56) References Cited

U.S. PATENT DOCUMENTS

| | | | |
|---|---|---|---|
| 1,690,286 | A | 11/1928 | Fitch et al. |
| 1,731,920 | A | 10/1929 | Boettger |
| 2,819,937 | A | 1/1958 | Bullock |
| 4,083,458 | A | 4/1978 | Young, Jr. |
| 4,604,955 | A | 8/1986 | Fleischer et al. |
| 4,648,517 | A | 3/1987 | Schafer |
| 5,224,429 | A | 7/1993 | Borgman et al. |
| 5,408,940 | A | 4/1995 | Winchell |
| 5,522,324 | A | 6/1996 | van Gelder et al. |
| 5,562,052 | A | 10/1996 | Glashouwer et al. |
| 5,588,376 | A | 12/1996 | Seidl et al. |
| 5,598,789 | A | 2/1997 | Jonker |
| 5,706,739 | A | 1/1998 | Shaheen et al. |
| 5,715,760 | A | 2/1998 | Frascaroli et al. |
| 5,715,761 | A | 2/1998 | Frattini |
| 5,752,449 | A | 5/1998 | Simon et al. |

(Continued)

*Primary Examiner* — Jose V Chen

(74) *Attorney, Agent, or Firm* — Buchanan Ingersoll & Rooney PC

(57) ABSTRACT

A table arrangement includes connection mechanisms for inter-connection of height adjustable tabletops so that the tabletops are independently moveable in a stable way. Embodiments of the table arrangement can be configured so that different height adjustable tabletops can be arranged to accommodate different users' preferences. Some embodiments of the table arrangement can utilize at least one cross-member connection mechanism connected to at least one column connection mechanisms 20.

20 Claims, 8 Drawing Sheets

(56) References Cited

U.S. PATENT DOCUMENTS

| | | | |
|---|---|---|---|
| 5,881,500 | A | 3/1999 | Latino et al. |
| 5,881,979 | A | 3/1999 | Rozier, Jr. et al. |
| 5,941,182 | A | 8/1999 | Greene |
| 6,029,587 | A | 2/2000 | Rozier, Jr. et al. |
| 6,164,217 | A | 12/2000 | Prendergast |
| 6,283,043 | B1 | 9/2001 | Stern et al. |
| 6,389,988 | B1 | 5/2002 | Frattini |
| 6,536,357 | B1 | 3/2003 | Hiestand |
| 6,546,880 | B2 | 4/2003 | Agee |
| 6,637,352 | B1 | 10/2003 | Thode et al. |
| 6,845,723 | B2 | 1/2005 | Kottman et al. |
| 7,036,438 | B2 | 5/2006 | Okamoto et al. |
| 7,066,098 | B2 | 6/2006 | Blasen et al. |
| D569,142 | S | 5/2008 | Burak |
| 7,614,351 | B2 | 11/2009 | Piretti |
| 7,712,422 | B2 | 5/2010 | Bue |
| 7,845,290 | B2 | 12/2010 | Piretti |
| 7,878,128 | B2 | 2/2011 | Watson et al. |
| 8,051,784 | B2 | 11/2011 | Hsu |
| 8,056,489 | B2 | 11/2011 | Nielsen |
| 8,069,795 | B1 | 12/2011 | Williams et al. |
| 8,091,488 | B2 | 1/2012 | Chirea et al. |
| 8,171,863 | B2 | 5/2012 | Nyenhuis et al. |
| 8,256,359 | B1 | 9/2012 | Agee |
| 8,297,208 | B2 | 10/2012 | Hoffman |
| 8,359,983 | B2 | 1/2013 | Williamson et al. |
| 8,413,593 | B2 | 4/2013 | Korb |
| 8,578,864 | B2 | 11/2013 | Nyenhuis et al. |
| 8,667,909 | B2 | 3/2014 | Ruzicka |
| 8,869,715 | B2 | 10/2014 | Hoffman |
| 9,265,340 | B2 | 2/2016 | Krusin et al. |
| 9,585,468 | B2 | 3/2017 | Udagawa et al. |
| D786,594 | S | 5/2017 | Yamamoto |
| 9,655,445 | B2 | 5/2017 | Gammon et al. |
| 10,413,063 | B2 * | 9/2019 | Lee ..... A47B 87/002 |
| 2007/0068429 | A1 | 3/2007 | Frazier |
| 2008/0196635 | A1 | 8/2008 | Piretti |
| 2008/0289545 | A1 | 11/2008 | Picchio |
| 2012/0126072 | A1 | 5/2012 | Pettersson |
| 2013/0204438 | A1 | 8/2013 | Hjelm |
| 2014/0331904 | A1 | 11/2014 | Troyner et al. |

* cited by examiner

TABLE CONNECTION MECHANISM AND METHOD OF USING THE SAME

CROSS-REFERENCE TO RELATED APPLICATIONS

The present application is a continuation application of U.S. patent application Ser. No. 16/101,872, which claims priority to U.S. Provisional Patent Application No. 62/545,195, filed on Aug. 14, 2017. The entirety of this provisional patent application is incorporated by reference herein.

FIELD OF INVENTION

The innovation relates to connection mechanisms that can be used in connection with table arrangements and height adjustable table arrangements. The innovation also relates to methods of making and using such connection mechanisms.

BACKGROUND OF THE INVENTION

Table arrangements can be utilized in different types of settings. In some office workplaces, tables can be arranged next to each other and separated via a cubicle system for example. In other arrangements, tables can be positioned in a large conference room for a conference. In yet other arrangements, a group of tables can be positioned near each other to facilitate collaborative work. Examples of tables and table arrangements can be appreciated from U.S. Patent Application Publication Nos. 2013/0204438 and 2012/0126072 and U.S. Pat. Nos. 9,585,468, 9,265,340, 8,667,909, 8,256,359, 8,056,489, 6,546,880, 6,536,357, 6,389,988, 6,029,587, 5,941,182, 5,881,979, 5,715,761, 5,706,739, 5,598,789, 5,562,052, 5,224,429, 5,408,940, and 4,604,955.

SUMMARY OF THE INVENTION

A new connection mechanism and method of using the connection mechanism are provided herein. I have determined that such a mechanism is needed to help facilitate an improvement in arranging tables so that tables and height adjustable tables can be arranged in various ways. In some embodiments, embodiments of my connection mechanism can be utilized in inter-connected table arrangements in which one table may be connected to at least one other table so that each table's tabletop is independently height adjustable and the interconnection of the tables can facilitate such independent relative motion and use with significant rigidity and significant stability. As another example, some embodiments of my table connection mechanism can be utilized so that a workspace can have at least two tabletops that are independently moveable relative to each other so at least to co-workers can use those tabletops in a workplace at different adjustable heights without having table legs positioned near the user's so that the users each have a significant amount of leg space to accommodate their comfort and desired working positions for each tabletop.

In some embodiments, a table arrangement can include a first tabletop, a second tabletop, and a base that supports the first and second tabletops. The base can comprise a first column positioned below the first tabletop, a second column positioned below the second tabletop, a first cross-member extending between the first column and the second column, a first bracket body attached to the first column, a first cross-member connection body attached within a first end of the first cross-member, and a first fastener extending from the first cross-member connection body to the first bracket body to attach the first cross-member connection body to the first bracket body so that the first bracket body and the first cross-member connection body are within the first end of the first cross-member and are spaced apart by a first gap.

The first gap can space the first cross-member connection body from the first bracket body by a distance of between 0.079375 cm and 2.54 cm in some embodiments. The gap can space the first cross-member connection body from the first bracket body so that there is no structure between these elements besides the portion of the fastener that may extend from the cross-member connection body to the bracket body. Air may surround the portion of the fastener that defines this gap. In some embodiments, the gap can space the first cross-member connection body from the first bracket body by a distance of about 0.635 cm. Of course, other embodiments may utilize a gap having a different pre-selected distance or a different gap distance within a pre-selected range of distances for the size of the gap (e.g. from ⅛ of an inch to 1 inch, 3/16 of an inch to ¾ of an inch, etc.).

The first and second tabletops can be considered tops of tables, desks, or counters. For instance, a tabletop can be considered a desktop or a countertop in some embodiments of the table arrangement. Each tabletop can be considered a work surface supported by one or more columns that can have a rectangular, circular, trapezoidal, hexagonal, pentagonal, or other type of shape.

In some embodiments of the table arrangement, the base can also include a second bracket body attached to the second column, a second cross-member connection body attached within a second end of the first cross-member, and a second fastener extending from the second cross-member connection body to the second bracket body to attach the second cross-member connection body to the second bracket body so that the second bracket body and the second cross-member connection body are within the second end of the first cross-member and are spaced apart by a second gap. The second gap can space the second cross-member connection body from the second bracket body by a distance of between 0.079375 cm and 2.54 cm, a distance of about 0.635 cm, or another pre-selected distance. In other embodiments the second gap can have a different pre-selected distance or a different gap distance within a pre-selected range of distances for the size of the gap (e.g. from ⅛ of an inch to 1 inch, 3/16 of an inch to ¾ of an inch, etc.).

The base can also include other columns, cross-bars, and other elements. For example, the base can also include a third column positioned below the first tabletop, a fourth column positioned below the second tabletop, a second cross-member extending between the third column and the fourth column, a third bracket body attached to the third column, a third cross-member connection body attached within a first end of the second cross-member, and a third fastener extending from the third cross-member connection body to the third bracket body to attach the third cross-member connection body to the third bracket body so that the third bracket body and the third cross-member connection body are within the first end of the second cross-member and are spaced apart by a third gap. The base can also comprise a fourth bracket body attached to the fourth column, a fourth cross-member connection body attached within a second end of the second cross-member, and a fourth fastener extending from the fourth cross-member connection body to the fourth bracket body to attach the fourth cross-member connection body to the fourth bracket body so that the fourth bracket body and the fourth cross-member connection body are within the second end of the second cross-member and are spaced apart by a fourth gap.

The third and fourth gap can have a size similar to the sized first gap and/or the sized second gap (e.g. be a gap of between 0.079375 cm and 2.54 cm, a gap of about 0.635 cm, etc.).

A bottom of the first cross-member can have a first opening in communication with a cavity or channel in which the first cross-member connection body is positioned such that the first fastener is insertable through the opening of the bottom of the cross-member and through a hole defined in the first cross-member connection body and a hole defined in the first bracket body. A bottom of the first cross-member can also have a second opening in communication with a cavity or channel in which a second cross-member connection body is positioned such that a second fastener is insertable through the second opening of the bottom of the first cross-member and through a hole defined in the first cross-member connection body and a hole defined in the first bracket body.

For embodiments that utilize a second cross-member, the bottom of the second cross-member can have a first opening in communication with a cavity or channel in which a cross-member connection body is positioned such that a fastener is insertable through the first opening of the bottom of the second cross-member and through a hole defined in a cross-member connection body and a hole defined in a bracket body. A bottom of the second cross-member can also have a second opening in communication with a cavity or channel in which another cross-member connection body is positioned such that another fastener is insertable through the second opening of the bottom of the second cross-member and through a hole defined in a cross-member connection body and a hole defined in a bracket body.

Each bracket body can have a number of different possible shapes. For instance, each first bracket body can have a shape generally resembling a "7". Each cross-member connection body can also have different shapes. For example, each cross-member connection body can be generally U-shaped or generally C-shaped or have another type of shape (e.g. generally V-shaped, etc.).

The cross-members and columns can also have different shapes. For example, columns may be generally rectangular or cylindrical in shape or may be vertically elongated structures having another type of shape. The cross-members can be elongated and be cylindrical, rectangular, or have another type of cross-sectional shape.

Methods of forming a table arrangement are also provided. Embodiments of the method can include use of an embodiment of a table arrangement. For instance, embodiments of the method can include providing a first column positioned below a first tabletop and a first cross-member where a first bracket body is attached to the first column and a first cross-member connection body is attached within a first end of the first cross-member, inserting a first fastener through the first cross-member connection body via an opening defined in a the first cross-member that is in communication with a cavity or channel in which the first cross-member connection body is positioned, passing the first fastener though a hole in the first bracket body after the first fastener is inserted through the first cross-member connection body, and rotating the first fastener to define a direct connection between the first bracket body and the first cross-member connection body such that a gap spaces the first cross-member connection body from the first bracket body by a distance of between 0.079375 cm and 2.54 cm.

Embodiments of the method can include other steps. For example, the method can also include providing a second column positioned below a second tabletop where a second bracket body is attached to the second column and a second cross-member connection body is attached within a second end of the first cross-member, inserting a second fastener through the second cross-member connection body via an opening defined in a the first cross-member adjacent the second end of the first cross-member that is in communication with a cavity or channel in which the second cross-member connection body is positioned, passing the second fastener though a hole in the second bracket body after the second fastener is inserted through the second cross-member connection body, and rotating the second fastener to define a direct connection between the second bracket body and the second cross-member connection body such that a gap spaces the second cross-member connection body from the second bracket body by a distance of between 0.079375 cm and 2.54 cm.

As another example, embodiments of the method can also include providing a third column positioned below a first tabletop and a second cross-member where a third bracket body is attached to the third column and a third cross-member connection body is attached within a first end of the second cross-member, inserting a third fastener through the third cross-member connection body via an opening defined in the second cross-member that is in communication with a cavity or channel in which the third cross-member connection body is positioned, passing the third fastener though a hole in the third bracket body after the third fastener is inserted through the third cross-member connection body, and rotating the third fastener to define a direct connection between the third bracket body and the third cross-member connection body such that a gap spaces the third cross-member connection body from the third bracket body by a distance of between 0.079375 cm and 2.54 cm.

As yet another example, embodiments of the method can also include providing a fourth column positioned below the second tabletop, a fourth bracket body attached to the fourth column and a fourth cross-member connection body being attached within a second end of the first cross-member, inserting a fourth fastener through the second cross-member connection body via an opening defined in a the second cross-member adjacent the second end of the second cross-member that is in communication with a cavity or channel in which the fourth cross-member connection body is positioned, passing the fourth fastener though a hole in the fourth bracket body after the fourth fastener is inserted through the fourth cross-member connection body, and rotating the fourth fastener to define a direct connection between the fourth bracket body and the fourth cross-member connection body such that a gap spaces the fourth cross-member connection body from the fourth bracket body by a distance of between 0.079375 cm and 2.54 cm.

Embodiments can utilize reinforcing members. For example, each bracket body can be attached to a respective reinforcing member. Embodiments of the method can include use of such reinforcing members. For example, embodiments of the method that utilize a table arrangement having first, second, third, and fourth bracket bodies can include the following steps: passing the first fastener through a first reinforcing member attached to the first bracket body, passing the second fastener through a second reinforcing member attached to the second bracket body, passing the third fastener through a third reinforcing member attached to the third bracket body, and passing the fourth fastener through a fourth reinforcing member attached to the fourth bracket body.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a table arrangement and connection mechanisms used in the table arrangement are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
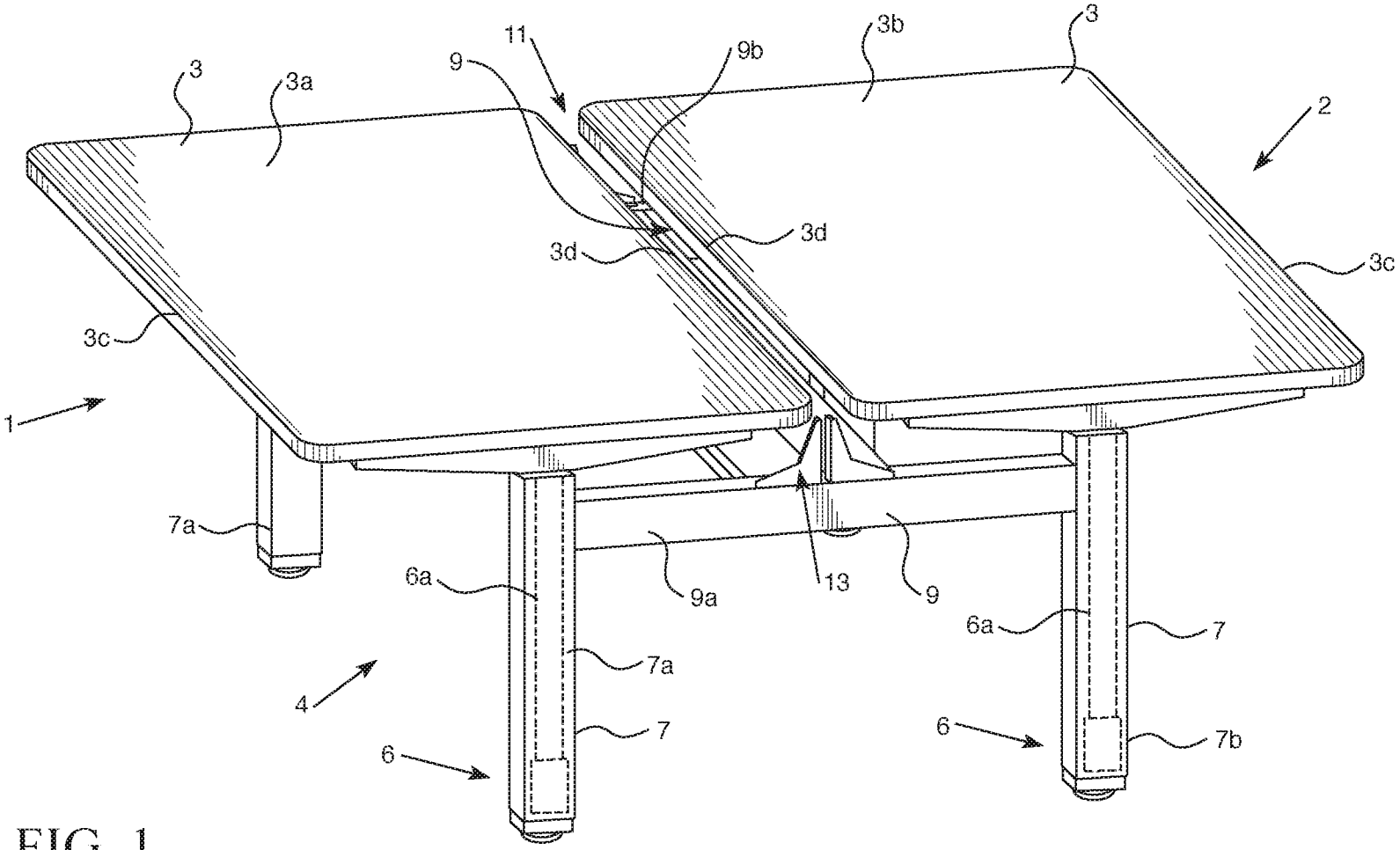
FIG. 1 is a perspective view of a first exemplary embodiment of a table arrangement 1 having multiple tabletops 3 that are independently height adjustable such that a first tabletop 3*a* is moveable to a different vertical position than a second tabletop 3*b*.
Figure 2:
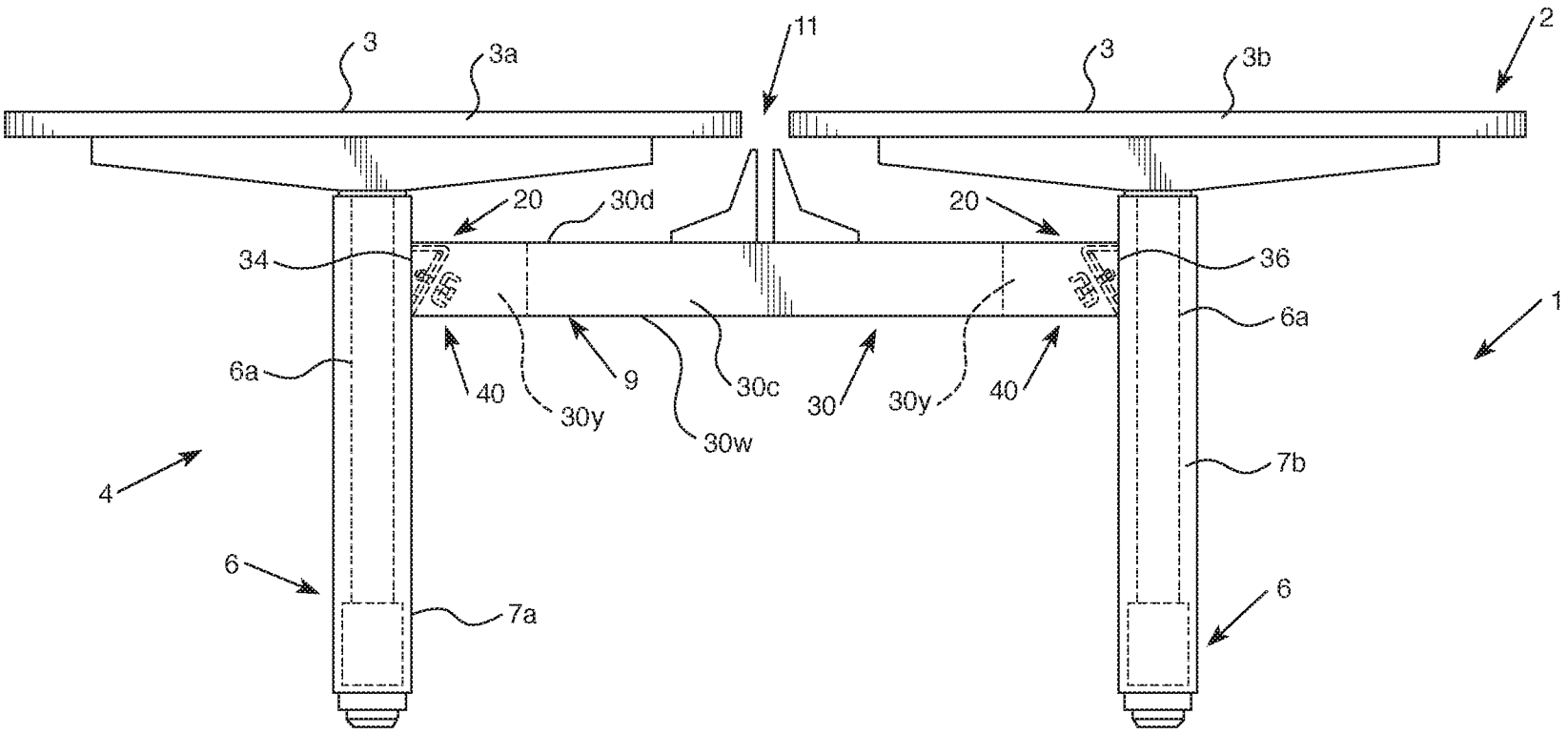
FIG. 2 is a left side view of the first exemplary embodiment of the table arrangement 1. A right side view of the first exemplary embodiment of the table arrangement 1 could be a mirror image of this left side view.
Figure 3:
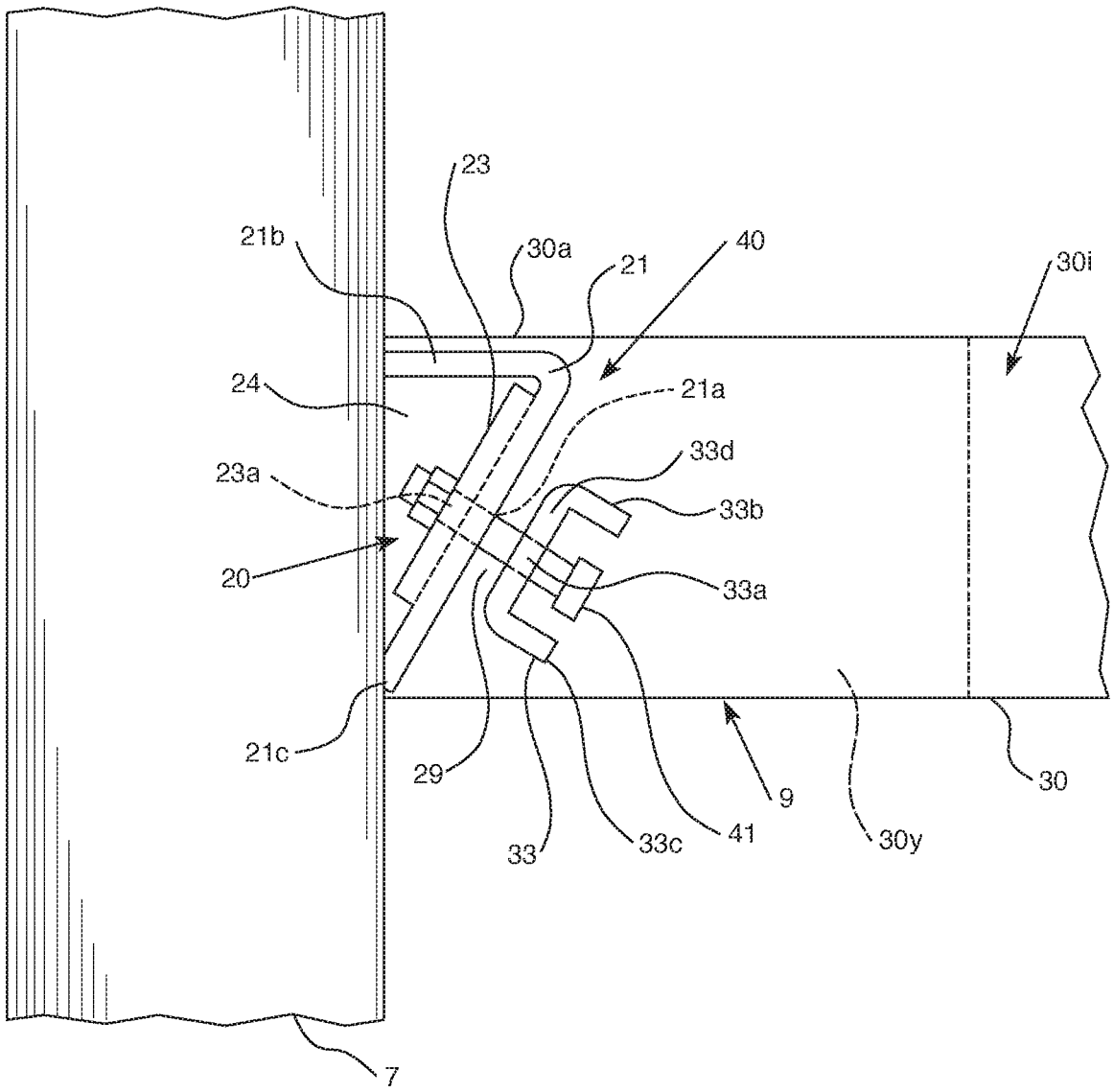
FIG. 3 is a fragmentary cross-sectional view of a first exemplary connection mechanism used for connecting the first and second tabletops 3*a* and 3*b* in the first exemplary embodiment of the table arrangement 1.
Figure 4:
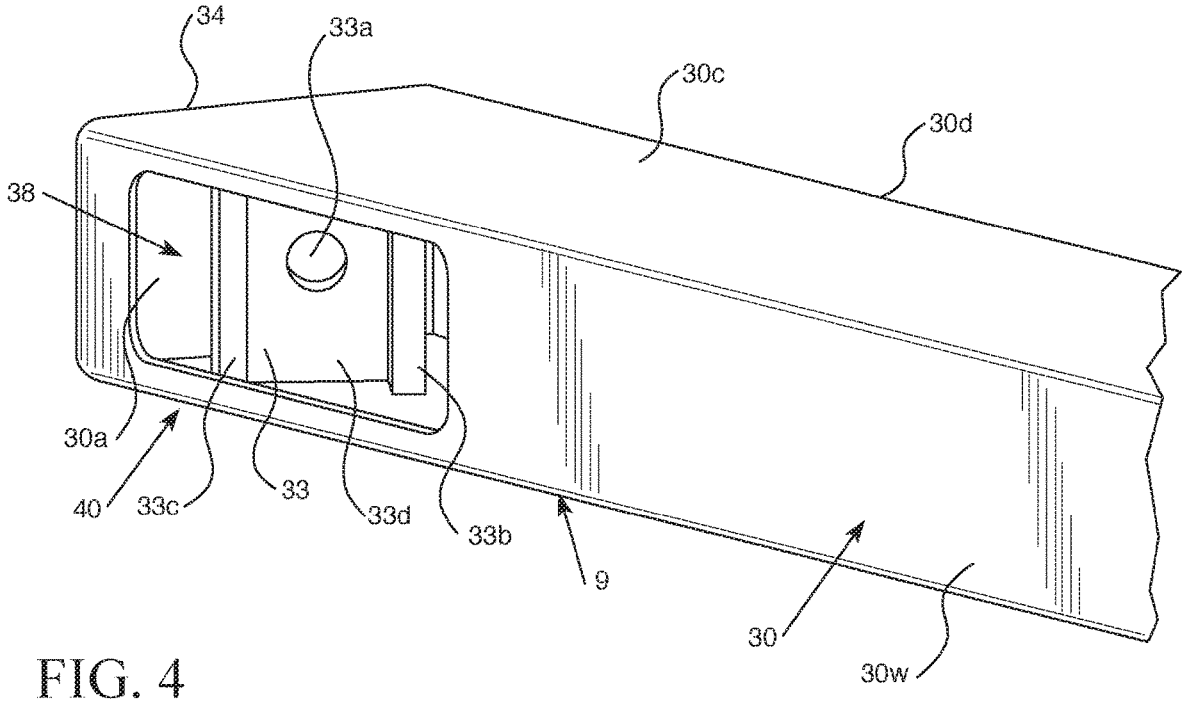
FIG. 4 is a bottom perspective view of an exemplary cross-member 9 structure for the cross-members 9 of the first exemplary embodiment of the table arrangement 1 that illustrates an exemplary cross-member connection mechanism 40 utilized in the first exemplary embodiment of the table arrangement 1.
Figure 5:
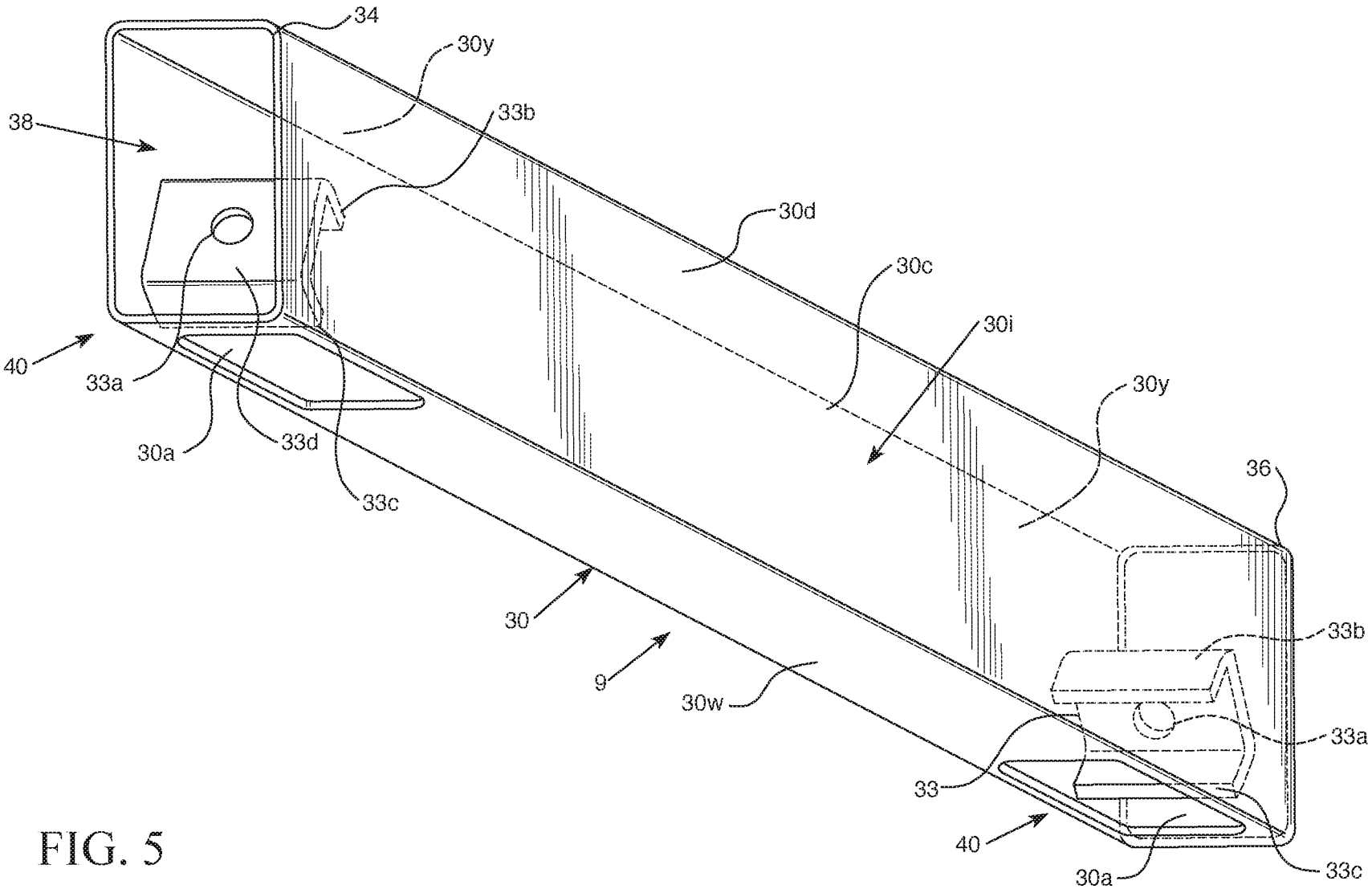
FIG. 5 is a perspective view illustrating the exemplary cross-member 9 structure for the cross-members 9 of the first exemplary embodiment of the table arrangement 1, which illustrates an exemplary cross-member connection mechanism 40 utilized in the first exemplary embodiment of the table arrangement 1.
Figure 6:
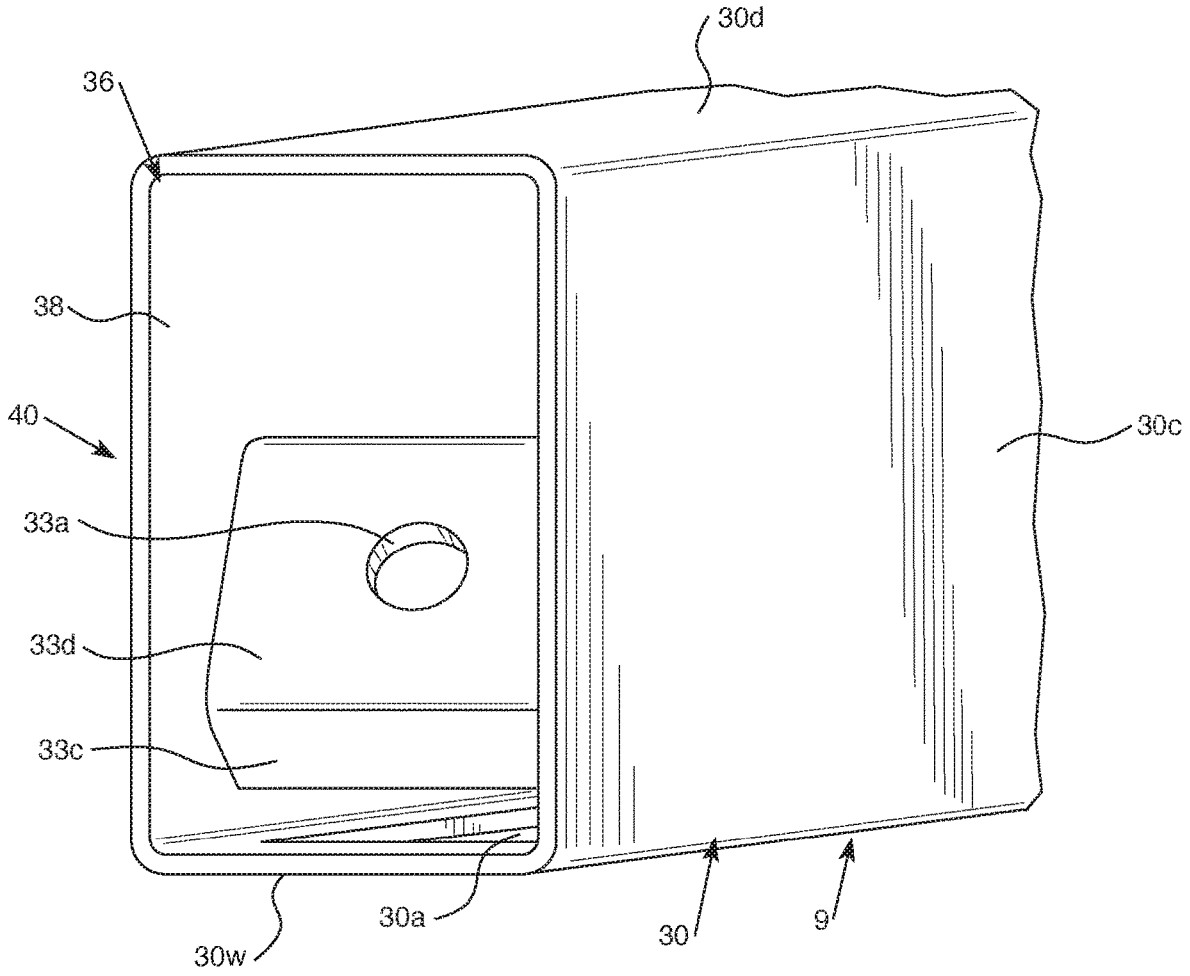
FIG. 6 is a fragmentary perspective view illustrating the exemplary cross-member 9 structure for the cross-members 9 of the first exemplary embodiment of the table arrangement 1 and an exemplary cross-member connection mechanism 40 utilized in the first exemplary embodiment of the table arrangement 1.
Figure 7:
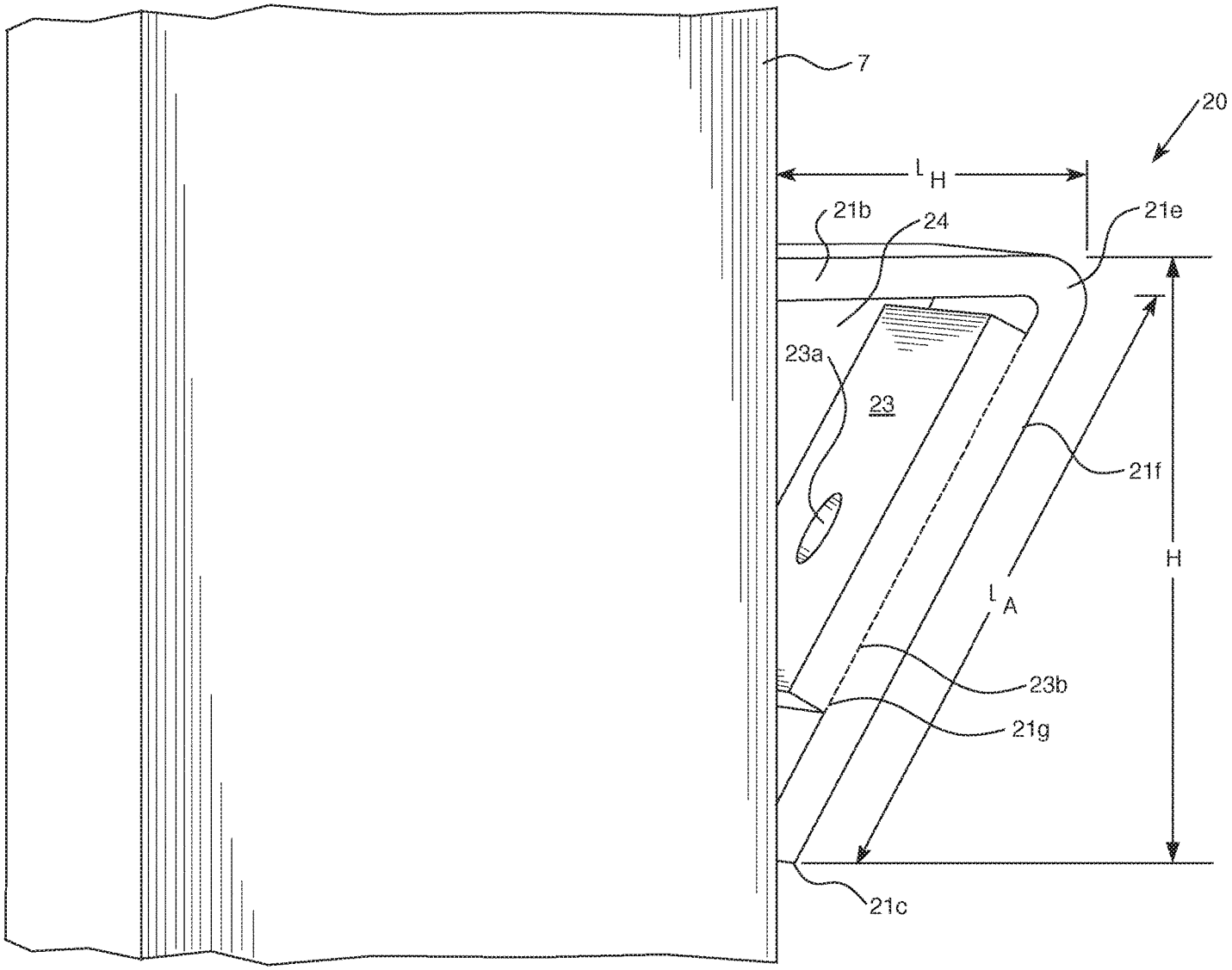
FIG. 7 is fragmentary perspective view of the table column connection mechanism 20 connected to a column 7 of the first exemplary embodiment of the table arrangement 1. As indicated by at least FIGS. 1 and 3, each column 7 of the first exemplary embodiment of the table arrangement 1 has such a respective connection mechanism 20 connected to it.
Figure 8:
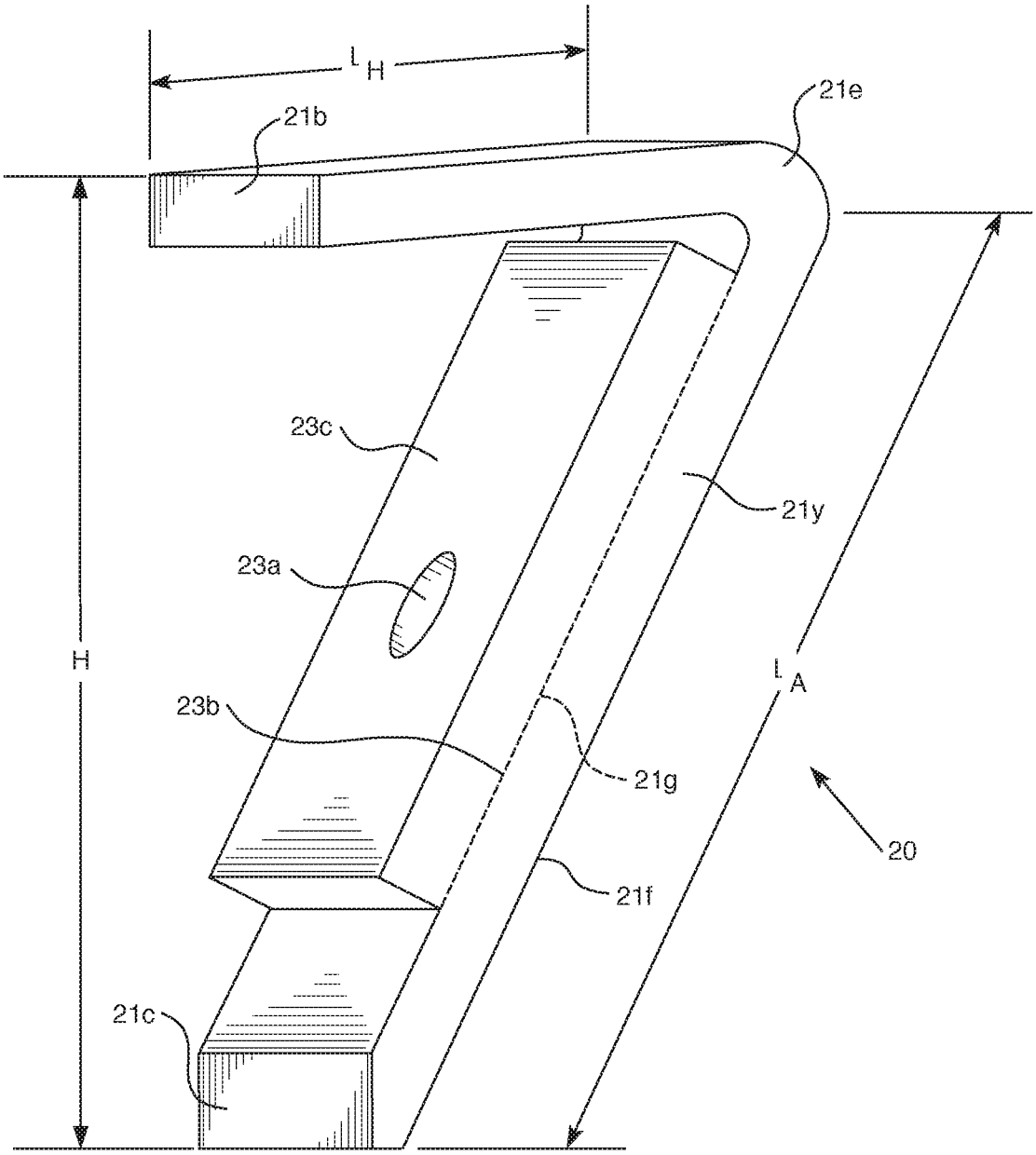
FIG. 8 is a perspective view of the exemplary embodiment of the connection mechanism 20 utilized in the first exemplary embodiment of the table arrangement 1.

Referring to FIGS. 1-8 a table arrangement 1 can include an assembly 2 that includes multiple tabletops 3 that are supported by a base 4. The base can include a plurality of columns 7 and cross-members 9. Each cross-member 9 can extend between a first column 7*a* that is connected to principally support a first tabletop 3*a* and a second column 7*b* that is positioned to principally support a second tabletop 3*b*. For some table arrangements, the table arrangement could be considered a workspace arrangement or cubicle type arrangement in which each tabletop 3 could be considered a work surface, a desktop, or a countertop.

For instance, the first columns 7*a* can include a pair of columns 7 that are spaced apart from each other and are located on opposite sides (e.g. left and right sides) of the first tabletop 3*a* near a middle section of the first tabletop 3*a* and second columns 7*b* can include a pair of columns 7 that are spaced apart from each other and are located on opposite sides (e.g. left and right sides) of the second tabletop 3*b* near a middle section of the first tabletop 3*b*. Each of the columns 7 can extend vertically along their length from a floor and the cross-members 9 can extend horizontally along their length between the first and second columns 7*a* and 7*b* to which it is connected. The first and second tabletops 3*a* and 3*b* can be positioned so that the tabletops' rear edges 3*d* are spaced apart from each other to define a gap 11 between the rear edges 3*d* of the tabletops. The columns 7 can be positioned so that the first columns 7*a* are positioned under the first tabletop 3*a* and the second columns 7*b* are positioned under the second tabletop 3*b*.

At least one cable management member 13 can be positioned adjacent and below the gap 11 to facilitate the routing of cables along the cable management member 13 and/or positioning of partition members that may extend through the gap 11 and above the tabletops 3 (e.g. cubical wall elements, privacy screen elements, etc.). The cable management member 13 can extend horizontally from a first side of each tabletop to a second side of each tabletop 3 so that the cable management member extends between the first and second cross-members 9*a* and 9*b* that each extends between a respective pair of the first and second columns 7*a* and 7*b* (the first cross-member 9*a* being positioned below and adjacent the first sides of the tabletops 3 and the second cross-member 9*b* being positioned below and adjacent the second sides of the tabletops 3).

Each column 7 can be configured to facilitate height adjustment of a tabletop 3. For example, the first columns 7*a* can be positioned adjacent a middle portion of the first tabletop 3*a* on opposite sides of the first tabletop between front and rear sides of the tabletop 3. Each first column 7*a* can include a telescoping member 6*a* that is extendable and retractable from a lower member of the column 7 so that actuation of the telescoping member results in height adjustment of the tabletop from a lowermost position to an uppermost position. As another example, the second columns 7*b* can be positioned adjacent a middle portion of the second tabletop 3*b* on opposite sides of the second tabletop 3*b* between front and rear sides of the tabletop 3. Each second column 7*b* can include a telescoping member 6*a* that is extendable and retractable from a lower member of the column 7 so that actuation of the telescoping member results in height adjustment of the tabletop 3 from a lowermost position to an uppermost position.

Each column 7 can include a height adjustment mechanism 6 (e.g. a gas spring, hydraulic spring, etc.) that is connected to the telescoping member 6*a* to drive motion of the telescoping member 6*a*. The height adjustment mechanism 6 can be coupled to an actuator to facilitate such height adjustment. A user may utilize the actuator to provide input for actuation of the height adjustment mechanism 6 so that the telescoping members 6*a* are vertically moveable for adjusting a position of a tabletop 3.

Each cross-member 9 can include an elongated tubular member 30 that can be circular (e.g. circle in cross-section, oval in cross-section, etc.) or polygonal in cross-section (e.g. rectangular cross-section, hexagonal cross-section, etc.). Each cross-member 9 can have a length that extends from its first end 34 to its second end 36 that is opposite its first end 34. Each cross-member 9 can also have a channel 30*i* that extends from its first end 34 to its second end 36. Each end of the channel of the cross-member can be in communication with mouths 38. A first mouth 38 can be defined at the first end 34 of the cross-member and a second mouth 38 can be defined at the second end 36 of the cross-member. Alternatively, each cross-member can have cavities 30*y* defined within the body of the cross-member adjacent to its first and second ends that are in communication with mouths 38 defined by the ends of the cross-member 9 such that the cross-member 9 does not have to be continuously hollow or be defined to have one continuous channel enclosed within the body of the cross-member 9.

The body of each of the cross-members 9 can include bottom openings 30*a*. Each bottom opening 30*a* can be positioned adjacent a respective end of the cross-member 9 (e.g. a first bottom opening 30*a* adjacent first end 34 and a second bottom opening 30*a* adjacent second end 36). In alternative embodiments, it is contemplated the bottom openings 30*a* could be defined in the top 30*d* of the cross-member 9 as top openings. The body of each cross-member 9 can also include spaced apart sidewalls 30*c* that extend from the bottom 30*w* of the body to a top 30*d* of the body between the first and second ends 34 and 36 of the cross-member 9. The top 30*d*, bottom 30*w*, and sidewalls 30*c* can define the mouths 38, channel 30*i* and/or cavities 30*y*.

The first and second ends 34 and 36 of each cross-member 9 can also include a cross-member connection mechanism 40. Each cross-member connection mechanism can include a cross-member connection body 33, which may be a generally U-shaped body, or generally C-shaped body, or other shaped body that is formed within the body of the cross-member 9 during molding of that member or is attached within the body of the cross-member 9 after the body of the cross-member is formed via welding, adhesive(s), fasteners (e.g. screws, bolts, rivets, etc.) and/or other type of fastening mechanism. When the cross-member connection body 33 of the cross-member connection mechanism 40 is attached within the cross-member 9, it can be affixed and non-moving relative to the cross-member 9 so that is held in a consistently maintained position adjacent an end of the cross-member 9.

Each cross-member connection mechanism 40 can include the generally U-shaped body 33 (or generally C-shaped body), which can include a central portion 33*d* that has a hole 33*a* defined therein. Hole 33*a* can be a central through hole 33*a* that is not threaded. Hole 33*a* can be sized to provide clearance for an intermediate portion of a body of a fastener so that the fastener 41 can pass through hole 33*a* for engagement within first hole 23*a* of reinforcing member 23 and/or first hole 21*a* of bracket body 21. The U-shaped body 33 (or C-shaped body) can include a lower end 33*c* and an upper end 33*b* that extend from the central portion 33*d* to define the U-shaped or C-shaped cross-member connection body 33. The central portion 33*d* can extend vertically from adjacent the bottom 30*w* of the cross-member toward the top 30*d* of the cross-member at an angle relative to horizontal. The lower and upper ends 33*c* and 33*b* can extend in a direction that is perpendicular to the direction at which the central portion 33*d* extends or substantially perpendicular to the central portion (e.g. within 10° or within 5° degrees of being perpendicular to the direction at which the central portion 33*d* extends from its lower side adjacent the bottom 30*w* of the cross-member to its upper side). The lower and upper ends 33*c* and 33*b* can be spaced apart from each other by the central portion 33*d*, extend such that they are parallel to each other, and extend from the central portion 33*d* to a distal end of the end portion such that the lower and upper ends 33*b* and 33*c* each extends downwardly from adjacent the central portion 33*d* to its distal end that is lower than its proximate end that is integral with the central portion 33*d*. The integral connections between the central portion 33*d* and the upper and lower ends can each include an intermediate curved portion or intermediate bent portion of the U-shaped or C-shaped cross-member connection body 33.

The hole 33*a* can be defined such that threads are defined in the central portion 33*d* and in communication with hole 33*a* to contact with and matingly engage with threads of a fastener 41 (e.g. a bolt or screw). The hole 33*a* can be sized and configured for alignment with first hole 21*a* of a bracket body 21 of the column connection mechanism 20. The bottom opening 30*a* can be sized and configured so that the fastener 41 is insertable through the hole 33*a* and so that a mechanical tool (e.g. a screwdriver) can be inserted into the cross-member 9 for engaging a head of the fastener for rotation of the fastener 41 for driving the fastener through the hole 33*a* of the cross-member connection body 33 and into holes of the column connection mechanism 20 (e.g. first hole 21*a* of bracket body 21 and first hole 23*a* of reinforcing member 23) for inter-connecting an end of the cross-member 9 to a column 7. In some embodiments, the engagement of the mechanical tool to the fastener 41 can occur via contacting the tool with the fastener so that rotation of the tool while the tool contacts the fastener drives rotation of the fastener 41. In other embodiments, the engagement of the mechanical tool with the fastener 41 may occur via the head of an attachment for the tool to contact the head of a fastener, so that subsequent rotation of the head of the tool drives rotation of the fastener.

Each column 7 can have a column connection mechanism 20 attached thereto for cooperating with a cross-member connection mechanism 40 for attaching an end of a cross-member 9 to that column 7 via at least one fastener 41 as referenced herein. The column connection mechanism 20 can include one or more elements. For example, the column connection mechanism 20 can include the bracket body 21 that is attached to a reinforcing member 23 so that a first threaded hole 23*a* of the reinforcing member 23 is aligned with a first threaded hole 21*a* of the bracket body 21 so that a fastener 41 is insertable through both of these holes after it is passed through hole 33*a*, inserted into at least the first threaded hole 21*a* of the bracket body 21, and rotated via the opening 30*a* in the bottom 30*w* of the cross-member 9. The fastener 41 can extend between the cross-member connection body 33 and the bracket body 21 to define a gap 29. The distance of the gap 29 between the cross-member connection body 33 and the bracket body 21 can be adjusted via rotation of the fastener 41. Rotation of the fastener 41 in a first direction (e.g. clockwise or counterclockwise) can cause the fastener to make gap 29 shorter. Rotation of the fastener 41 in a second direction opposite the first direction can cause the fastener to make the gap 29 larger.

The fastener 41 can be positioned to provide a desired gap 29 while also positioning an end of a cross-member at a desired position near a column to which that end is to be connected (e.g. the end of the cross-member can contact the column or be positioned to be within a 1/32 of an inch to 1/8 of an inch from the column, etc.). For many embodiments, the desired position of the end of the cross-member to a column 7 will be a position in which each end of the cross-member 9 contacts a respective column 7. The size of the gap 29 can be a pre-selected desired size to meet a particular design objective. In some embodiments, the gap 29 can be defined to help ensure that all the fastener tension of fastener 41 serves to pull an end of the cross-member 9 and the column 7 to which that end of the cross-member is attached toward each other to provide improved rigidity to the connection between the end of the cross-member 9 and the column 7.

The bracket body 21 can be shaped like a "7" or have a generally "7" type shape. The bracket body 21 can include an upper end 21*b* that has its distal portion welded or otherwise affixed to a part of the column 7 (e.g. adhesive, fastener, welding, combinations thereof, etc.).

The bracket body can also include a lower end 21*c* that has its distal portion welded or otherwise affixed to a part of the column 7 (e.g. adhesive, fastener, welding, combinations thereof, etc.) at a location below where the upper end 21*b* is affixed to the column 7. The upper end 21*b* of the bracket body can extend from the column 7 to an intermediate upper curved portion 21*e* along an upper length $L_H$ of the bracket body. The bracket body 21 can have an elongated segment 21*y* that extends from this upper curved portion 21*e* to the lower end 21*c* along a length $L_A$ of this portion of the bracket body 21. The length $L_A$ can extend at an angle relative to vertical so that the length $L_A$ is greater than a height H of the bracket body 21 that can be defined by the vertical distance between the upper end 21*b* and the lower end 21*c*. The angle relative to vertical can be an angle of between 30° and 80° or an angle of between 45° and 75° in some embodiments.

The bracket body can have an intermediate portion 21*f* that extends along length $L_A$ from the intermediate upper curved portion 21*e* to the lower end 21*c*. The intermediate portion 21*f* can extend at an angle relative to the upper end 21*b* that is within a pre-selected angle range. For instance, the angle at which the intermediate portion 21*f* extends that is relative to the upper end 21*b* can be in the range of 15°-75° (e.g. 30°, 45°, 60°, etc.). This intermediate portion 21*f* can have an outer face that faces toward the cross-member connection body 33 and an inner face 21*g* that faces toward the reinforcing member 23 (and column 7 to which the bracket body 21 is attached). The shape of the bracket body 21 can resemble a "7" such that there is a generally triangular opening 24 defined between the bracket body 21 and the column to which it is attached.

The reinforcing member 23 can be a separate element that is coupled to the bracket body 21 or can be an integral portion of the bracket body 21 that is formed with the bracket body 21. Preferably, the reinforcing member 23 is a separate element that is formed and subsequently welded or otherwise affixed to the bracket body so that the first hole 23*a* of the reinforcing member is aligned with the first hole 21*a* of the bracket body 21 for receipt of fastener 41 as it driven through the bracket body 21 and into the reinforcing member 23 via aligned holes 21*a* and 23*a* and rotation of the fastener 41 driven by a tool that engages the fastener 41 positioned in hole 33*a* of the cross-member connection body 33 via opening 30*a* of the cross-member. The reinforcing member 23 can be a plate, bar, or other type of member that is configured for positioning on a substantial portion of the intermediate portion 21*f* of the bracket body 21. An inner face 23*b* of the reinforcing member 23 can be in contact with or otherwise engage the inner face 21*g* of the intermediate portion 21*f* of the bracket body 21. This inner face 23*b* can be attached to the inner face 21*g* of the intermediate portion 21*f* via welding, adhesive, or other type of fastening mechanism for an integral attachment between the reinforcing member 23 and bracket body 21. The reinforcing member 23 can be positioned so it is within the generally triangular shaped opening 24 defined between the bracket body 21 and the column 7. The reinforcing member 23 can be sized in depth, width, and length to help reinforce the intermediate portion 21*f* (e.g. improve this portion's rigidity, toughness, and/or strength) and provide additional depth in structure for the fastener 41 for facilitating a stronger connection between the cross-member connection body 33 and the bracket body 21 provided via the fastener 41 and aligned threaded holes 33*a*, 21*a*, and 23*a*.

The fastener 41 can be passed through the holes 33*a*, 21*a*, and 23*a* to fasten an end of the cross-member 9 to a column 7. This connection can be formed such that the distal end of the cross-member 9 contacts an outer wall of the column 7 to which the bracket body 21 is attached so that the bracket body 21, reinforcing member 23, and cross-member connection body 33 are generally enclosed within the body of the cross-member 9 and is generally hidden from view via the body of the cross-member 9 (other than through opening 30*a*). The fastener 41 can be configured to extend between the cross-member connection body 33 and the bracket body 21 such that there is a gap 29 between the intermediate portion 21*f* of the bracket body 21 and the central portion 33*d* of the cross-member connection body 33. The gap 29 can extend from the outermost face of the intermediate portion 21*f* to the outermost face of the central portion 33*d* of the cross-member connection body 33. This gap 29 can be present after the end of the cross-member 9 is attached to the column 7 so that the gap is maintained between the cross-member connection body 33 and the bracket body 21. The gap 29 can be about 1 inch distance between the cross-member connection body 33 and the bracket body 21 or may be another type of distance. For instance, the gap can define a spaced relationship of about ¼ of an inch (0.635 cm), up to 1 inch (2.54 cm), between 1/16 of an inch (0.15875 cm) and an 1 inch (2.54 cm), between 1/32 of an inch (0.079375 cm) and 1 inch, between ⅛ of an inch (0.3175 cm) and ¾ of an inch (1.905 cm), between ⅛ of an inch (1.5875 cm) and ⅝ of an inch (1.5875 cm) or between ⅛ of an inch and ¾ of an inch. If the gap 29 is about ¼ of an inch (0.635 cm), it may be between ⅛ of an inch and ⅜ of an inch, between 3/16 of an inch (0.47625 cm) and 5/16 of an inch (0.79375 cm), or between 3/16 of an inch and ⅜ of an inch.

The gap 29 can function to help provide improved rigidity to the connection between the cross-member 9 and the column 7 by facilitating a structural relationship between the cross-member 9 and column 7 to which it is attached that can function as a spring to bias against forces that may be exerted by a user at a tabletop 3 that may lean on the tabletop or otherwise provide a force that acts on the tabletop 3 and is transferred to the cross-member 9 and column 7 interconnection. This biasing force that can be created via the gap 29 and arrangement of the cross-member connection body and bracket body 21 provided via the gap 29 in response to this user generated force at a tabletop 3 can help counteract such a force to improve the stability and/or rigidity of the base 4 supporting the tabletops 3 (e.g. the user's perception that the tabletop is rigidly supported).

The connection between an end of a cross-member and a column 7 via the cross-member connection mechanism 40 and the column connection mechanism 20 can be at each end of each cross-member 9. For example, the first end 34 of the first cross-member 9*a* can have such a connection to a first column 7*a* and the first end 34 of the second cross-member 9*a* can have such a connection to the other first column 7*a* at its first end 34 and the second ends 36 of these cross-members 9 can have such connections at the second columns 7*b* to which they attach. For some table arrangements that utilize two tabletops (e.g. a first tabletop 3*a* and a second tabletop 3*b*), there may be at least two cross-members 9 and at least four columns 7. For such arrangements, there may be more than one cross-member connection mechanism 40 and more than one column connection mechanism 20. For instance, there may be four cross-member connection mechanisms 40 and four column connection mechanisms 20—a first set at a first column/first end of a first cross-member connection, a second set at a second column/second end of the first cross-member connection, a third set at a third column/first end of a second cross-member connection, a fourth set at a fourth column/second end of the second cross-member connection.

For instance, there may be a first bracket body 21 attached to the first column 7, a first cross-member connection body 33 attached within a first end of a first cross-member 9 and a first fastener 41 extending from the first cross-member connection body to the first bracket body to attach the first cross-member connection body to the first bracket body so that the first bracket body and the first cross-member connection body are within the first end of the first cross-member and are spaced apart by a first gap 29. There can also be a second bracket body 21 attached to a second column 7, a second cross-member connection body 33 attached within a second end of the first cross-member 9 and a second fastener 41 extending from the second cross-member connection body to the second bracket body 21 to attach the second cross-member connection body to the second bracket body so that the second bracket body and the second cross-member connection body are within the second end of the first cross-member and are spaced apart by a second gap 29. There can also be a third bracket body 21 attached to a third column 7, a third cross-member connection body 33 attached within a first end of a second cross-member 9 and a third fastener 41 extending from the third cross-member connection body to the third bracket body 21 to attach the third cross-member connection body to the third bracket body so that the third bracket body and the third cross-member connection body are within the first end of the second cross-member and are spaced apart by a third gap 29. There can also be a fourth bracket body 21 attached to a fourth column 7, a fourth cross-member connection body 33 attached within a second end of the second cross-member 9 and a fourth fastener 41 extending from the fourth cross-member connection body to the fourth bracket body 21 to attach the fourth cross-member connection body 33 to the fourth bracket body 21 so that the fourth bracket body 21 and the fourth cross-member connection body 33 are within the second end of the second cross-member 9 and are spaced apart by a fourth gap 29. Each gap 29 can space apart the bracket body 21 and the cross-member connection body 33 by a pre-selected distance (e.g. up to an inch, between 3/16 of an inch to an inch, between 3/8 of an inch and an inch, etc.).

Such embodiments can also utilize reinforcing members 23. For instance, there may be a first reinforcing member 23 attached to the first bracket body 21, a second reinforcing member attached to the second bracket body 21, a third reinforcing member 23 attached to the third bracket body 21, and a fourth reinforcing member 23 attached to the fourth bracket body 23. In other embodiments, only some of the bracket bodies may be attached to a respective reinforcing member 23. It should be appreciated that other embodiments of the table arrangement 1 can utilize less than four cross-member connection mechanisms 40 and less than four column connection mechanisms 20. For instance, there may only be a first set at a first end of a first cross-member 9/first column 7 connection and a second set at a second end of the second cross-member 9/fourth column 7 connection. In yet other embodiments, there may be more than four columns 7, more than two cross-members 9, more than four cross-member connection mechanisms 40 and more than four column connection mechanisms 20. There may also be more than two tabletops 3.

It was surprisingly determined that the gap 29 played a significant and substantial role in improving the stability of embodiments of the table arrangement 1. For instance, the significance of the gap 29 was assessed via a finite element analysis (FEA) to compare the use of the gap 29 to a use in which the gap 29 was not present and the cross-member connection body contacted the bracket body 21 along the intermediate portion 21*f*. The finite element analysis results found that 57% of deflection that could result from a user exerted force could be eliminated via use of the gap 29. This reduction in deflection that would be experienced at the bracket body 21/cross-member connection body 33 direct connection location defined by fastener 41 and aligned holes 23*a*, 21*a*, and 33*a* can result in a substantial improvement in stability of the base 4 that can be felt and appreciated by users. Such appreciation by users can result in users feeling that the base 4 provides a solid, rigid support for the tabletops 3. For instance, the tabletops 3 supported by the base 4 can feel more stable (e.g. less rocking, less vibration, less "wobble" may be experienced or felt by a user). The base 4 also may not rock or wobble much, if at all, when a tabletop 3 is vertically adjusted relative to another tabletop 3 or when both tabletops are vertically adjusted at the same time to different user desired locations.

It should be understood that embodiments of the table arrangement 1 and connection mechanisms used in that embodiment may be configured to meet different design criteria. For example, the shape and composition of the reinforcing member can be any of a number of suitable parameters to meet a particular set of design criteria. The reinforcing member can be made of steel, aluminum, or another type of metal or other type of material for example. As another example, the shape, size, and dimension of the bracket body 21 could be any number of shapes or sizes and could be composed of metal (e.g. steel, aluminum, etc.) or another type of material. As yet another example, the shape and size of the cross-member connection body 33 can be a different shape (e.g. V-shaped, L-shaped, C-shaped, etc.) and can be composed of a metal (e.g. steel or aluminum etc.) or another type of suitable material. The cross-member 9 and column 7 can also be different shapes, sizes, or configurations and can be composed of metal (e.g. steel, aluminum, etc.) or another type of material. As yet another example, the tabletops 3 may not be height adjustable or may be height adjustable and also be pivotable or otherwise moveable. As yet another example, the bottom of each column may be configured to contact a floor, be connected to a foot for stationary positioning on the floor, or be connected to a rollable wheel or castor. As yet another example, there may be more than two columns (e.g. three columns, four columns, etc.) under any particular tabletop 3 to principally support that tabletop in some embodiments of the table arrangement 1. Therefore, while certain exemplary embodiments of the table arrangement and connection mechanisms used in the table arrangement and methods of making and using the same have been discussed and illustrated herein, it is to be distinctly understood that the invention is not limited thereto but may be otherwise variously embodied and practiced within the scope of the following claims.

What is claimed is:

1. A table arrangement comprising:

a first tabletop;

a second tabletop;

a first column positioned below the first tabletop;

a second column positioned below the second tabletop;

a first cross-member extending between the first column and the second column;

a first bracket body being attached to the first column;

a first cross-member connection body being attached within the first cross-member, and a first fastener extending from the first cross-member connection body to the first bracket body to attach the first cross-member connection body to the first bracket body so that the first bracket body and the first cross-member connection body are within a first end portion of the first cross-member and are spaced apart by a first gap.

2. The table arrangement of claim 1, wherein the first gap spaces the first cross-member connection body from the first bracket body by a distance of between 0.079375 cm and 2.54 cm.

3. The table arrangement of claim 1, wherein the first gap spaces the first cross-member connection body from the first bracket body by a distance of about 0.635 cm.

4. The table arrangement of claim 1, also comprising:

a second bracket body being attached to the second column;

a second cross-member connection body being attached within the first cross-member, a second fastener extending from the second cross-member connection body to the second bracket body to attach the second cross-member connection body to the second bracket body so that the second bracket body and the second cross-member connection body are within a second end portion of the first cross-member and are spaced apart by a second gap.

5. The table arrangement of claim 4, wherein the second gap spaces the second cross-member connection body from the second bracket body by a distance of between 0.079375 cm and 2.54 cm.

6. The table arrangement of claim 4, wherein the second gap spaces the second cross-member connection body from the second bracket body by a distance of about 0.635 cm.

7. The table arrangement of claim 4, also comprising:

a third column positioned below the first tabletop;

a fourth column positioned below the second tabletop;

a second cross-member extending between the third column and the fourth column;

a third bracket body being attached to the third column;

a third cross-member connection body being attached within the second cross-member, a third fastener extending from the third cross-member connection body to the third bracket body to attach the third cross-member connection body to the third bracket body so that the third bracket body and the third cross-member connection body are within a first end portion of the second cross-member and are spaced apart by a third gap.

8. The table arrangement of claim 7 also comprising:

a fourth bracket body attached to the fourth column;

a fourth cross-member connection body being attached within the second cross-member, a fourth fastener extending from the fourth cross-member connection body to the fourth bracket body to attach the fourth cross-member connection body to the fourth bracket body so that the fourth bracket body and the fourth cross-member connection body are within a second end portion of the second cross-member and are spaced apart by a fourth gap.

9. The table arrangement of claim 8, wherein:

the third gap spaces the third cross-member connection body from the third bracket body by a distance of between 0.079375 cm and 2.54 cm; and the fourth gap spaces the fourth cross-member connection body from the fourth bracket body by a distance of between 0.079375 cm and 2.54 cm.

10. The table arrangement of claim 8, wherein:

the third gap spaces the third cross-member connection body from the third bracket body by a distance of about 0.635 cm; and the fourth gap spaces the fourth cross-member connection body from the fourth bracket body by a distance of about 0.635 cm.

11. The table arrangement of claim 1, also comprising:

a third column positioned below the first tabletop;

a fourth column positioned below the second tabletop;

a second cross-member extending between the third column and the fourth column;

a second bracket body being attached to the third column;

a second cross-member connection body being attached within the second cross-member, a second fastener extending from the second cross-member connection body to the second bracket body to attach the second cross-member connection body to the second bracket body so that the second bracket body and the second cross-member connection body are within a first end portion of the second cross-member and are spaced apart by a second gap.

12. The table arrangement of claim 11, also comprising:

a third bracket body attached to the fourth column;

a third cross-member connection body being attached within the second cross-member, a third fastener extending from the third cross-member connection body to the third bracket body to attach the third cross-member connection body to the third bracket body so that the third bracket body and the third cross-member connection body are within a second end portion of the second cross-member and are spaced apart by a third gap.

13. The table arrangement of claim 1, wherein a bottom of the first cross-member has a first opening in communication with a cavity or channel in which the first cross-member connection body is positioned such that the first fastener is insertable through the opening of the bottom of the first cross-member and through a hole defined in the first cross-member connection body and a hole defined in the first bracket body.

14. The table arrangement of claim 1, wherein the first bracket body has a shape generally resembling a "7" and wherein the first cross-member connection body is generally C-shaped.

15. The table arrangement of claim 1, wherein the first cross-member connection body is generally U-shaped.

16. A method of forming a table arrangement comprising:

providing a first column positioned below a first tabletop and a first cross-member, a first bracket body being attached to the first column and a first cross-member connection body being attached within the first cross-member, inserting a first fastener through the first cross-member connection body via an opening defined in the first cross-member that is in communication with a cavity or channel in which the first cross-member connection body is positioned;

passing the first fastener though the first bracket body after the first fastener is inserted through the first cross-member connection body;

moving the first fastener to define a direct connection between the first bracket body and the first cross-member connection body such that a gap spaces the first cross-member connection body from the first bracket body.

17. The method of claim 16, wherein the first cross-member has a first end and a second end, the method also comprising:

providing a second column positioned below a second tabletop, a second bracket body being attached to the second column and a second cross-member connection body being attached within the first cross-member, inserting a second fastener through the second cross-member connection body via an opening defined in the first cross-member adjacent the second end of the first cross-member that is in communication with a cavity or channel in which the second cross-member connection body is positioned;

passing the second fastener though a hole in the second bracket body after the second fastener is inserted through the second cross-member connection body;

moving the second fastener to define a direct connection between the second bracket body and the second cross-member connection body such that a gap spaces the second cross-member connection body from the second bracket body.

18. The method of claim 16, comprising:

providing a second column positioned below the first tabletop and a second cross-member, a second cross-member connection body being attached within the second cross-member;

providing a third column below a second tabletop, a second bracket body being attached to the third column below the second tabletop;

inserting a second fastener through the second cross-member connection body via an opening defined in the second cross-member that is in communication with a cavity or channel in which the second cross-member connection body is positioned;

passing the second fastener though the second bracket body after the second fastener is inserted through the second cross-member connection body;

moving the second fastener to define a direct connection between the second bracket body and the second cross-member connection body such that a gap spaces the second cross-member connection body from the second bracket body.

19. The method of claim 16, wherein the gap spacing the first cross-member connection body from the first bracket body is between 0.079375 cm and 2.54 cm.

20. The method of claim 16, comprising:

passing the first fastener through a first reinforcing member attached to the first bracket body.

* * * * *